US010070729B2

(12) United States Patent
Frankel et al.

(10) Patent No.: US 10,070,729 B2
(45) **Date of Patent: *Sep. 11, 2018**

(54) FOLDING CHAIR WITH A SIDE BAG ON ONE SIDE

(71) Applicant: Zenithen USA LLC, Diamond Bar, CA (US)

(72) Inventors: Andrew David Frankel, Yorba Linda, CA (US); Shi-Ping Zheng, Fuzhou (CN); Tian-Xia Zheng, Fujian (CN)

(73) Assignee: Zenithen USA, LLC, Upland, CA (US)

( * ) Notice: Subject to any disclaimer, the term of this patent is extended or adjusted under 35 U.S.C. 154(b) by 79 days.

This patent is subject to a terminal disclaimer.

(21) Appl. No.: 15/229,425

(22) Filed: Aug. 5, 2016

(65) Prior Publication Data

US 2018/0035810 A1 Feb. 8, 2018

(51) Int. Cl.
*A47C 4/28* (2006.01)
*A47C 7/62* (2006.01)

(52) U.S. Cl.
CPC ..... *A47C 7/62* (2013.01); *A47C 4/286* (2013.01)

(58) Field of Classification Search
CPC .. A47C 4/286; A47C 4/48; A47C 4/28; A47C 4/24; A47C 4/283
See application file for complete search history.

(56) References Cited

U.S. PATENT DOCUMENTS 3,000,667 A * 9/1961 Dryden ..... A01K 97/06 297/183.5
6,629,722 B1 * 10/2003 Tang ..... A47C 7/62 297/188.08
7,604,288 B1 * 10/2009 Verhulst ..... A45F 4/02 297/129
8,752,889 B1 * 6/2014 Nievinski ..... F41A 23/14 297/184.11
2004/0227381 A1 * 11/2004 Redzisz ..... A47C 4/283 297/42
2008/0012399 A1 * 1/2008 Lin ..... A47C 4/283 297/188.08
2010/0164256 A1 * 7/2010 Salisbury ..... A47C 4/286 297/16.2
2013/0328362 A1 * 12/2013 Miller ..... A47C 7/62 297/188.2
2014/0252817 A1 * 9/2014 Lovley, II ..... A47C 7/66 297/184.15
2014/0312659 A1 * 10/2014 Moon ..... A47C 7/54 297/16.2

(Continued)

*Primary Examiner* — Timothy J Brindley
(74) *Attorney, Agent, or Firm* — Merek, Blackmon & Voorhees, LLC

(57) ABSTRACT

The present invention is to a folding chair with a side bag on one side, composed of a folding stand as well as seat fabric and backrest fabric fixed to the folding stand. When the folding stand is opened, the seat fabric and the backrest fabric are in an unfolded open state with a side bag and a packing strap are provided at the seat fabric edge or on the handrail. The packing strap is behind the side bag. A corresponding locking mechanism is provided at the bottom of the side bag and the packing strap. When the folding stand is folded, the side bag and the packing strap will wrap around the outer sides in opposite directions, forming a binding packaging structure with the interlock of the locking mechanism at the bottom of the side bags.

5 Claims, 4 Drawing Sheets

(56) References Cited

U.S. PATENT DOCUMENTS

| | | | | |
|---|---|---|---|---|
| 2015/0230618 | A1* | 8/2015 | Scott | A47C 4/286<br>297/180.13 |
| 2017/0127837 | A1* | 5/2017 | Brune | A47C 4/28 |
| 2018/0027970 | A1* | 2/2018 | Frankel | A47C 4/30 |

* cited by examiner

FOLDING CHAIR WITH A SIDE BAG ON ONE SIDE

BACKGROUND OF THE INVENTION

Field of the Invention

This utility model belongs to the field of folding furniture. Specifically, it is a type of folding chair with a side bag on one side. The side bag can be used to pack up the folded folding chair and it also provides a space to accommodate objects.

Technical Background

Existing folding chairs are widely used. They are appliances for sitting or lying on for people who are at leisure or may be engaged in outdoor activities. Currently there are two types of folding form chairs. One is a flat folding form in which the folding chair has a compact, planar structure after it is folded. This type of folding chair is generally suitable for use in gardens and other relatively stable environments. The second type is a three-dimensional folding form, which means that it folds completely. It can be folded into a bundle and is easy to carry, especially in outdoor activities. It has become a standard tool for outdoor sports. Three-dimensional folding chairs are equipped with side bags; these side bags can be used to pack up the folding chair when it is folded into a bundle; they also restrain the folding stand so that it does not open up, making it hard to carry and store; this also greatly reduces the volume occupied by the stand. A three-dimensional folding chair is composed of a folding stand as well as a seat fabric and a backrest fabric that are hung on the stand. Each face of the folding stand is linked by crossing articulated diagonal bar sets. The diagonal bar points in neighboring faces that are articulated by the upper corner plate and the lower corner plate and other components to form a linked integrated structure. Once the positions of two particular intersecting diagonal bars are relatively fixed, the folding stand of a folding chair cannot be opened, which makes it convenient to pack and store the folding chair. By contrast, the traditional approach to packing up this sort of chair is to use a separate bag. For this sort of finished product, the overall condition is good, but the bag is separate from the chair and it is easily lost in the use process, causing inconvenience of re-storage and re-packing of the chair. How to solve this problem is the object of research of this utility model.

SUMMARY OF THE INVENTION

This invention was produced with the intention of designing a type of folding chair with a side bag and a packing strap at the seat fabric edge or on the handrail on one side of a folding chair; wherein after the chair is folded, the side bag and the packing strap wrap around the outer sides of the folding stand to form a packaging structure by which the chair can be carried.

The technical solution of this invention is achieved as follows: it is a type of folding chair with a side bag on one side, composed of a folding stand as well as seat fabric and backrest fabric fixed to the folding stand. When the folding stand is opened, the seat fabric and the backrest fabric are in an unfolded or "open" state. Its characteristics are: a side bag and a packing strap provided at the seat fabric edge or on the handrail on one side of the folding chair. The packing strap is behind the side bag. A corresponding locking mechanism is provided at the bottom of the side bag and the packing strap respectively. When the folding stand is folded, the side bag and the packing strap will wrap around the outer side in opposite directions, forming a binding packaging structure with the interlock of the locking mechanism at the bottom of the side bag and the packing strap.

The above mentioned locking mechanism could be one of the following structures: zippers, buckles, snap buttons, VELCRO, or lacing straps.

The above mentioned side bag can be produced as pockets wherein objects can be placed. There may be at least one cup holder to place a cup in.

The above mentioned side bag is positioned at the point where the seat fabric is affixed to the folding stand.

This invention is ingenious with a reasonable design and is easy to use. It has a side bag and a packing strap on one side of the folding chair. The side bag can be produced as pockets or cup holders. When the folding chair is opened for use, the bag provides the convenience of holding objects or cups; when the chair is folded, the side bag can wrap around the outside of the folding stand to form a binding/carrying package/function. This dual function not only simplifies packaging, but also has strong integrity, eliminating the need for a packing bag.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

BRIEF DESCRIPTION OF THE DRAWINGS

The invention is further described below with specific illustrations.

1—folding stand
11—support frame
111—handrail
2—seat fabric
3—backrest fabric
4—side bag
41—pocket
42—cup holder
43—hand strap
5—packing strap
6—zipper Similar reference characters denote corresponding features consistently throughout the attached drawings.

DETAILED DESCRIPTION OF THE PREFERRED EMBODIMENT(S)

Figure 1:
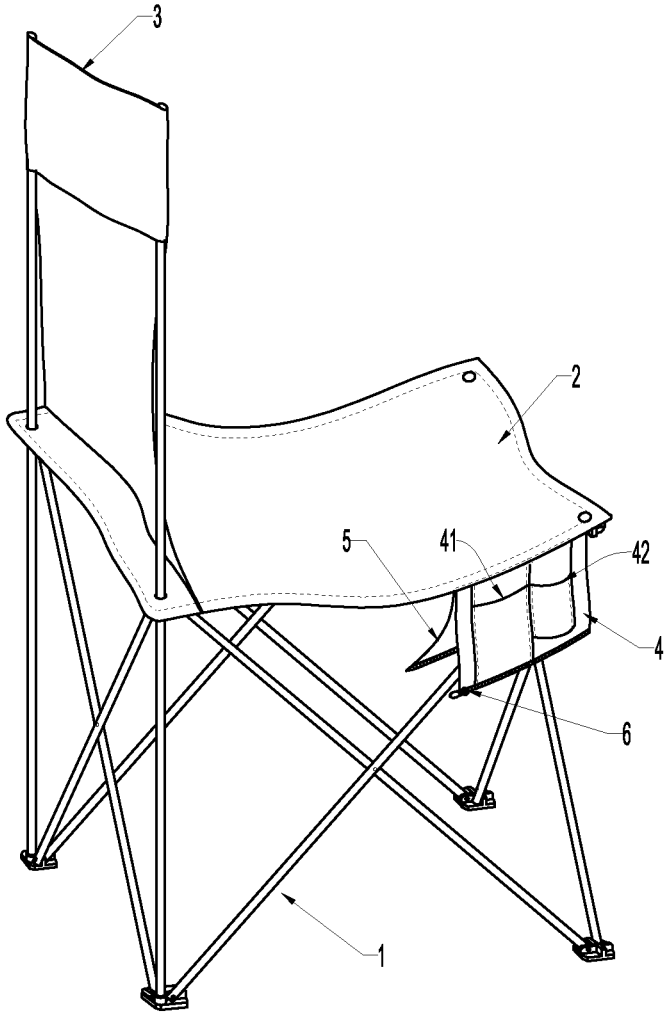
FIG. 1 is a perspective schematic of the folding chair according to a first embodiment.
Figure 2:
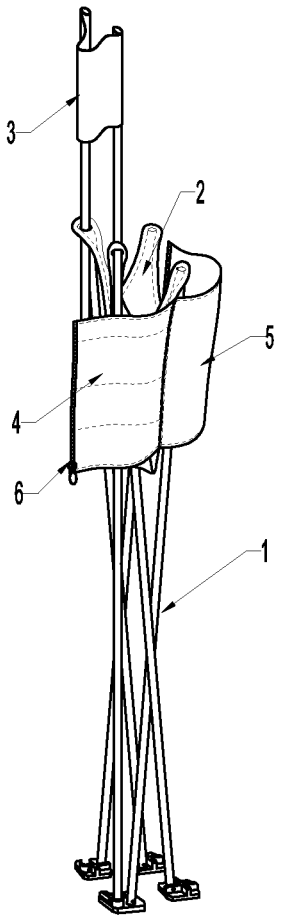
FIG. 2 is a schematic of the folding stand of FIG. 1 in its folded or "stored" state.
Figure 3:
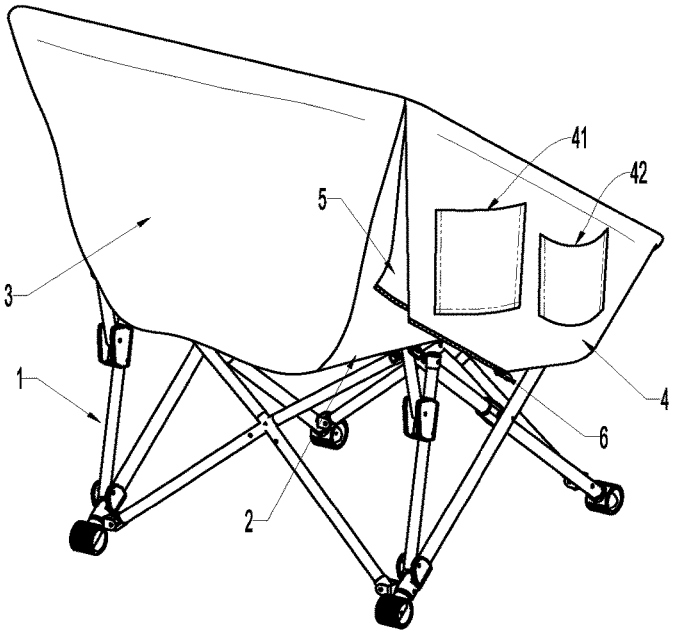
FIG. 3 is a perspective schematic of the Folding Chair according to a second embodiment.
Figure 4:
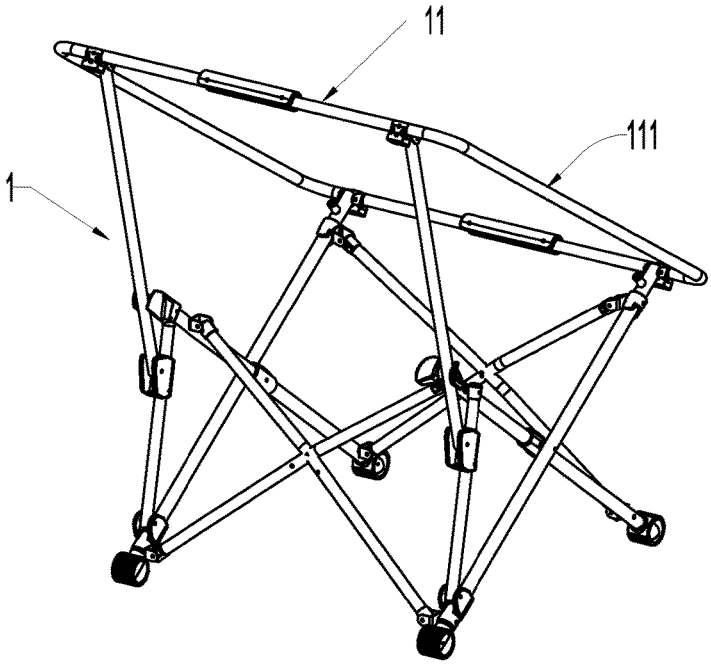
FIG. 4 is a schematic of the folding stand of the Folding Chair according to a second embodiment.
Figure 5:
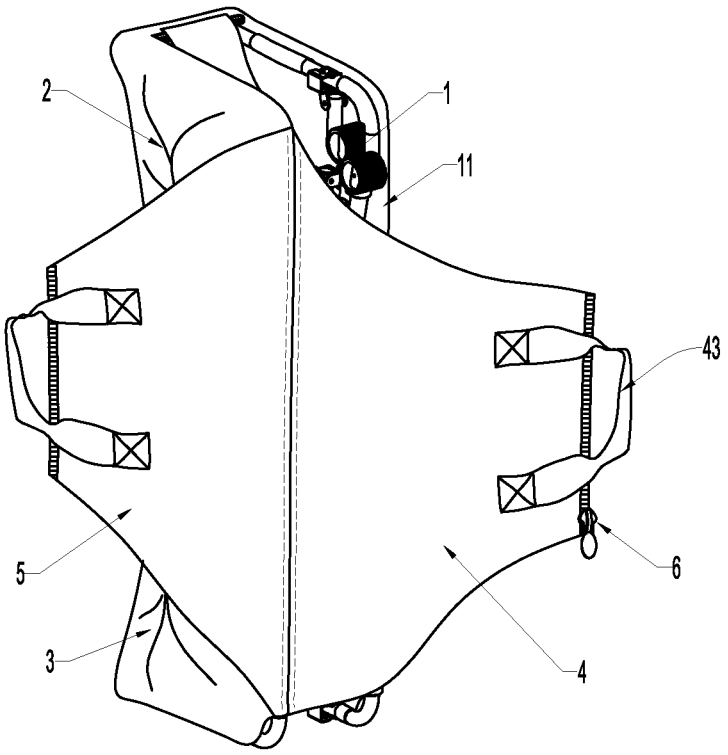
FIG. 5 is a schematic of the folding process of the Folding Chair according to a second embodiment.
Figure 6:
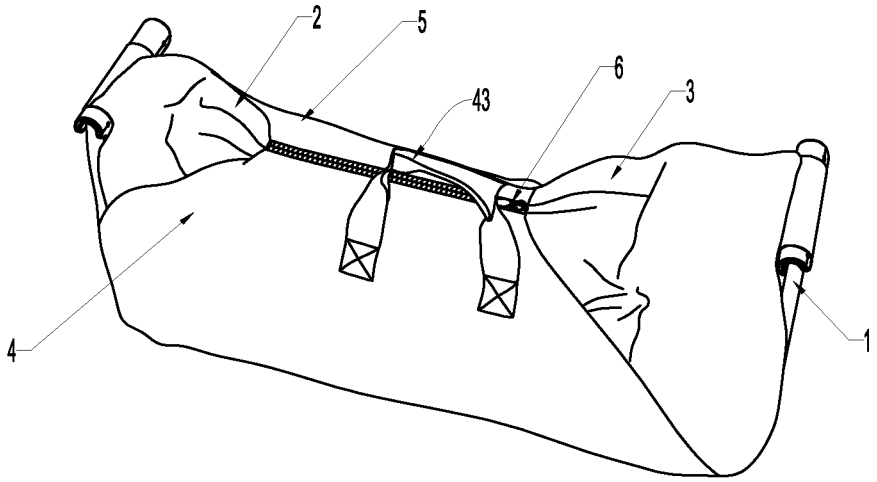
FIG. 6 is a schematic of the Folding Chair according to a second embodiment in its folded and packed state In the drawings.

Referring to FIGS. 1 and 2, it can be seen that the folding chair with a side bag on one side is composed of a folding stand 1 as well as a seat fabric 2 and a backrest fabric 3 fixed onto the folding stand. When the folding stand 1 is opened, the seat fabric and the backrest fabric will be in an open state. A side bag 4 and a packing strap 5 are provided at the edge of seat fabric 2 on one side of the folding chair. The packing strap 5 is behind the side bag 4 and can be sewn to the edge of seat fabric 2 with the same seam. Side bag 4 can be produced as a pocket 41 and should preferably have at least one cup holder 42 to hold a water cup or bottle to fully meet a users' outdoor need to hold objects as well as water cups. At the bottom of side bag 4 and packing strap 5, there is a cooperative locking mechanism. The afore-mentioned locking mechanism could be one of the following structures: zippers, buckles, snap buttons, VELCRO, or lacing straps. In this sample, the locking mechanism is a zipper 6. The two teeth elements of zipper 6 are respectively stitched to the bottom edge of side bag 4 and packing strap 5. The depth of the side bag 4 is determined by the practical needs of pocket 41 and cup holder 42. The length of the packing strap 5 is determined by the diameter of the folding stand 1 when it is folded. When the folding stand 1 is folded, the side bag 4 and the packing strap 5 wrap around the outer sides of the folding stand 1 in opposite directions, with the interlocking mechanism of zipper 6 at the bottom of the side bag 4 and the packing strap 5 forming a binding packaging structure for folding stand 1. This also protects the seat fabric 2 and the backrest fabric 3 from dust and stains. Therefore, the shape of the packing strap 5 is similar to that of the side bag 4. It should not be longer than the side bag 4 and can be hidden from view behind the side bag 4.

In addition, when the folding stand 1 is folded, the seat fabric 2 will be folded for storage. Therefore, the width of the side bags 4 should be no larger than half the depth to which the seat fabric 2 hangs when it is folded. The side bag can be placed at the front or rear of the seat. The best option is to have the side bag 4 placed at the point where seat fabric 2 is affixed to folding stand 1, that is to say, the side bag 4 is close to the support point to have better load bearing support.

In this sample, the seat fabric 2 is in a suspension structure with the suspension points at the four corners of the stand. This can be applied to folding chairs whose seat fabric is affixed to support bars on both sides. In this case, the side bag and the packing strap are sewn to the edge of seat fabric 2 on one side of the seat and the edge of both sides of seat fabric 2 is provided with a cloth cover. The cloth cover covers the outside of the support bars to form support for the seat fabric.

Referring now to FIG. 3 through 6, it can be seen that in this sample chair, there is a foldable support frame 11 above the folding stand 1. This support frame 11 forces open the conjoined seat fabric 2 and backrest fabric 3. In other words, the conjoined backrest fabric 3 and seat fabric 2 are hung on the support frame 11 to form the folding chair on which a person can sit. Furthermore, the two sides of the support frame 11 perform the function of handrails ("arm rests") 111 on which to place arms. A handrail 111 is equipped with a side bag 4 and a packing strap 5. At the bottom of the side bag 4 and the packing strap 5, there is a cooperative locking mechanism, namely, the zipper 6. When the folding stand is folded, the side bag 4 and the packing strap 5 will wrap around the outer sides of the folding stand in opposite directions, forming a binding packaging structure with the interlock of zipper 6.

Moreover, the side bag 4 is hung off of the handrails 111. It's load-bearing; but when packed, its edge is level and smooth. The shape of the packing strap 5 is similar to that of the side bag 4. Its length is determined by practical circumstances, but is preferably not be longer than the side bag 4. Since it is hidden behind side bag 4, it will not affect the appearance of the product. In addition, when necessary, a hand strap 43 can be sewn to the corresponding position of the packing strap 5 and the side bag 4 to carry the folding chair when it is folded.

In summary, the side bag 4 and the packing strap 5 are placed at one side of the handrails 111, such that they are sewn to the handrail fabric. This can be applied to any folding chair with handrails to form an integrated folding chair with self-contained packing device.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as maybe applied to the central features hereinbefore set forth, and fall within the scope of the invention and the limits of the appended claims. It is therefore to be understood that the present invention is not limited to the sole embodiment described above, but encompasses any and all embodiments within the scope of the following claims.

We claim:

1. A folding chair with a side bag on one side, comprising:

a folding stand and a seat fabric and a backrest fabric fixed to the folding stand;

wherein when the folding stand is in a first, opened state, the seat fabric and the backrest fabric are spread out in an unfolded open state;

a side bag and a packing strap are provided at an edge of the seat fabric or on a handrail on one side of the folding chair wherein the packing strap is behind the side bag;

a locking mechanism is provided at the bottom of the side bag and the packing strap;

wherein when the folding stand is a second, folded state, the side bag is wrapped around an outer side of the stand in first direction and the packing strap is wrapped around an outer side in a second, opposite direction and where a first end of the packing strap is connected to a first end of the side bag to retain the chair in the second, folded state.

2. The folding chair of claim 1, wherein the locking mechanism is selected from the group of a zipper, a buckles, a snap, a hook and loop fastener, and a strap.

3. The folding chair of claim 1, wherein the side bag is sized to function as a pocket in which objects can be placed; and and further including at least one cup holder mounted to at least one of the handrails.

4. The folding chair of claim 3, wherein the side bag is positioned at the point at which the seat fabric is affixed to the folding stand.

5. The folding chair of claim 1, wherein the side bag is positioned at the point at which the seat fabric is affixed to the folding stand.

* * * * *